United States Patent [19]

Bridges et al.

[11] 4,304,092

[45] Dec. 8, 1981

[54] NOVELTY SLUB FIBER

[75] Inventors: Thomas P. Bridges, Covington; Paul R. Cox, Jr., Conyers, both of Ga.

[73] Assignee: Hercules Incorporated, Wilmington, Del.

[21] Appl. No.: 160,519

[22] Filed: Jun. 18, 1980

[51] Int. Cl.[3] ..... D02G 3/34

[52] U.S. Cl. ..... 57/207; 57/6; 57/227; 57/350; 57/908

[58] Field of Search ..... 57/3, 6, 12, 206, 207, 57/208, 209, 210, 225, 226, 227, 228, 284, 289, 332, 333, 350, 351, 908; 28/247, 252, 271

[56] References Cited

U.S. PATENT DOCUMENTS

| | | | |
|---|---|---|---|
| 3,078,654 | 2/1963 | Marshall | 57/207 X |
| 3,427,647 | 2/1969 | Field, Jr. | 57/6 X |
| 3,763,640 | 10/1973 | Nagel et al. | 57/6 |
| 3,945,189 | 3/1976 | Allen | 57/6 X |
| 4,069,656 | 1/1978 | Arai | 57/6 |

*Primary Examiner*—Donald Watkins

*Attorney, Agent, or Firm*—William S. Alexander

[57] ABSTRACT

A method of producing a slub fiber is disclosed in which a metered core yarn is fed into a vortex generator and an effect yarn under continuous low level tension is fed into the balloon formed by the core yarn at the exit of the vortex generator such that the point at which the effect yarn contacts the core yarn balloon is free to move randomly, allowing the said effect yarn to form a randomized slub effect.The combined yarns are then passed through a texturing jet to more permanently bind the yarns together.

5 Claims, 2 Drawing Figures

NOVELTY SLUB FIBER

BACKGROUND OF THE INVENTION

This invention relates to a process for the production of yarns, and more particularly, for the production of slub yarns. Slub yarns are well known to the art. The process of the present invention, however, provides a slub yarn in a continuous process without employing any additional mechanical apparatus to produce the slub as is normally required by the prior art. In particular, the present invention provides a randomized slub effect which is not possible with the prior art.

In U.S. Pat. Nos. 2,997,837 and 3,043,087 a slub yarn and the process for preparing the yarn are shown. In this process an effect yarn or staple is added as a slub to a continuous carrier yarn. The cranking action of the carrier yarn as it enters a fluid twister is used to pull along the effect staple fibers or the continuous effect yarn. Passing the combined yarns or yarn and staple fibers through the fluid twister serves to wrap the effect yarn more permanently about the carrier. The slubs are characterized by being wrapped about the carrier yarn with both an S twist and a Z twist.

In U.S. Pat. No. 3,438,194, a process for the production of a slub yarn is shown. Like the yarn of the present invention, this slub yarn consists of two or more components; at least one carrier yarn and one or more effect yarns. However, unlike the present invention, this process involves varying the feed rate of at least one of the component yarns. Specific apparatus is disclosed for the purpose of varying this feed rate.

U.S. Pat. No. 3,640,064 shows a slub yarn which is also produced by intermittently relieving the tension of one of two multi-filament yarns as they are fed simultaneously into a fluid bulking jet.

U.S. Pat. Nos. 4,155,216 and 4,159,619 show a slub yarn and the method of producing the yarn. The yarn is prepared by mechanically tensioning and relaxing the yarn while it passes through a fluid tangling zone.

It is an object of the present invention to provide a slub yarn in which slubs of one or more continuous effect yarns are added to one or more carrier yarns without the necessity of providing means to mechanically vary the tension in one of the yarns.

It is a further object of the present invention to produce a yarn with a randomized slub effect.

According to the present invention there is disclosed a method of producing a slub fiber comprised of at least one core yarn and at least one effect yarn comprising the steps of feeding an effect yarn directly into the balloon formed by the core yarn at the exit of the vortex generator while maintaining on said effect yarn a low, but continuous and relatively constant tension, and to allow said effect yarn freedom to make contact at a random point on the balloon, to spontaneously form a slub.

This invention will be understood from the following detailed description and the accompanying drawings.

DETAILED DESCRIPTION OF THE INVENTION

Figure 1:
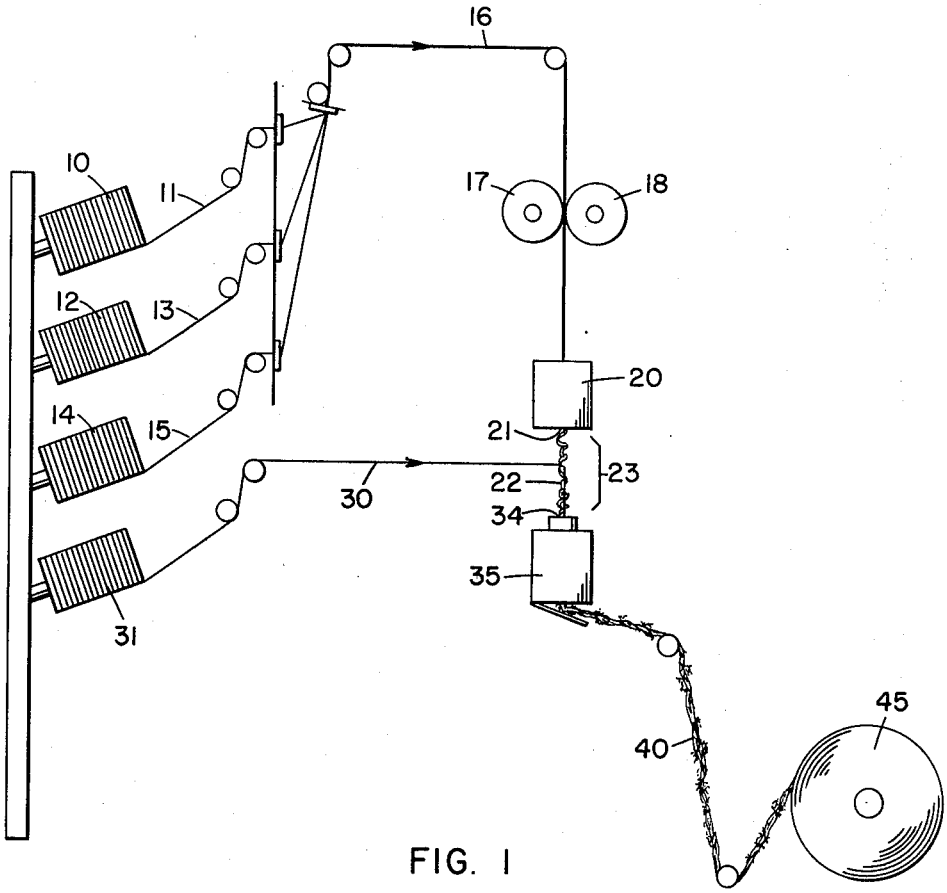
FIG. 1 represents a schematic illustration of the process of the present invention.

In accordance with the present invention, a process is disclosed which will produce a slub yarn having varying sized slubs of an effect yarn at random points along a core or carrier yarn. This process is illustrated by the schematic drawing of FIG. 1. In the embodiment shown, three spools, shown as (10), (12) and (14) in FIG. 1, each contain staple or non-staple filament yarn, (11), (13) and (15), respectively, and these said yarns are combined and used as the core or carrier yarn (16) of the present invention. These combined yarns are fed at a rate controlled by feed rolls (17) and (18) into a fluid vortex generator (20), such as the splicing jet described in U.S. Pat. No. 3,407,581. This vortex generator (20) causes the core yarn (16) to form a balloon of twisting yarn (22) extending from point (21) where the said core yarn exits from the vortex generator (20) to the entrance of a fluid operated texturing or bulking jet such as that described in U.S. Pat. No. 3,471,911 or 3,457,611, at (34).

At the same time, a staple or non-staple filament effect yarn (30) is fed under low, but continuous and relatively constant tension from spool (31) directly into the balloon (22) of the core yarn (16). The tension on the effect yarn, which can be provided by a resistance on the spool or by passing the yarn through a set of feed rollers, will generally affect the size of the resulting slub. Generally, the greater the tension on the effect yarn, the smaller the slub. The size of the slub will also vary with a number of other variables, such as the pressure on the vortex generator and the size of the balloon, the denier of the effect yarn, and the speed of operation. All of these may be varied to achieve specific operating conditions which will produce a finished yarn with the desired esthetic qualities. The tension on the effect yarn may be as high as 30 grams, but best results have been obtained at tensions between 2 and 10 grams. The effect yarn (30) is free to join the balloon (22) at any point along the length of said balloon, represented by the area designated (23) extending from point (21) to point (34) in the diagram of FIG. 1. Utilizing the process of the invention described herein, it has been found that the point at which the effect yarn (30) joins the balloon (22) varies randomly and rapidly over the entire length (23) of the balloon. This random movement creates random slubs of effect yarn along the continuous core yarn (16).

The combined core and effect yarns, (16) and (30) respectively, are then advantageously fed into a fluid texturing jet of a type known to the art, represented as (35) which has the effect of binding the yarns together in a more permanent manner.

The resulting slub yarn (40) is then fed onto a take-up roll, represented as (45) in the diagram of FIG. 1.

Figure 2:
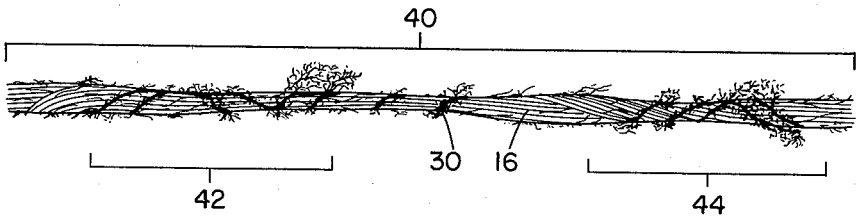
FIG. 2 shows a portion of the slub yarn produced by the process of the present invention.

FIG. 2 represents a portion of the slub yarn (40) produced by the process of the present invention. The continuous core yarn (16) has been combined with an effect yarn (30) which has looped about the core yarn (16) and has created random slubs in the areas shown as (42) and (44) on the yarn shown in FIG. 2.

The following examples will help to illustrate the present invention.

EXAMPLE 1

A novelty slub yarn was prepared using one end of 1550 denier continuous filament spin-draw yarn having 100 filaments (1550/100) as the core yarn and one end of 300 denier continuous filament drawn yarn having 72 filaments (300/72) as the effect yarn. The core yarn had been melt-colored with a light beige pigment. The effect yarn had been melt-colored with a medium brown shade pigment.

The core yarn threadline was passed from the creeled package through a tension gate to the core yarn feed roll. From the feed roll the core yarn passed through a vortex generator which was being operated by 25 pounds per square inch gauge (p.s.i.g.) saturated steam pressure. This caused a false twisting action and filament intermingling on the core yarn. As the threadline passed on to a texturing jet which was 2 inches away a large balloon was formed by the filaments before the threadline entered the texturing jet. An effect yarn was passed from the creel to join the core yarn at a point where the core yarn was ballooning. Surprisingly, the effect yarn spontaneously moved up and down the balloon causing a slub to be formed in the threadline as it entered the steam operated texturing jet. After passing through the texturing jet, which bound the two threadlines together, the yarn passed over a take-off roll and was wound on a package. Operating conditions were as follows:

Core Yarn Feed Roll Speed—194 meters/minute
Take-off Roll Speed—153 meters/minute
Winding Speed—164 meters/minute
Steam Pressure on Vortex generator—25 p.s.i.g.
Steam Pressure on texturing jet—100 p.s.i.g.
Texturing Jet Size—0.090 inch orifice diameter tip/0.103 inch orifice diameter seat, straight flow distributor, 0.5 pound per minute steam flow.
Tension on core yarn between vortex generator and texturing jet—50-60 grams
Tension on the effect yarn just prior to contact with core yarn—5 to 10 grams.

The wound yarn was highly textured and had large slubs randomly distributed along the threadline. The finished yarn had a denier of 2068.

EXAMPLE 2

A novelty slub yarn was prepared using three ends of 1550 denier, 200 filaments, drawn straw-colored continuous filament yarn as a core yarn and one end of 2150 denier, 120 filaments, drawn, orange-red pigmented continuous filament yarn as an effect yarn. The core yarn was run as in Example 1 from the creel to the core feed roll which was operating at 194 meters per minute rotational speed. The core yarn threadline was then passed through a vortex generator under the same conditions as set out in Example 1, and on through a texturing jet being operated by 110 p.s.i.g. saturated steam. From the texturing jet, the core yarn threadline was passed to a take-off roll being run at 185 meters per minute rotational speed. A large balloon formed in the yarn between the vortex generator and the texturing jet.

The effect yarn threadline was pulled from the package under 10 to 20 grams of tension and passed under this tension to the balloon of the core yarn. At this point the two threadlines met; however, the effect yarn threadline spontaneously moved up and down the balloon of the core yarn until the two entered the texturing jet, which had a 0.127 inch orifice diameter tip and a 0.104 inch orifice seat and was operated at 26 pounds per hour steam consumption. After leaving the texturing jet the two threadlines (core yarn and effect yarns) were permanently bound as a single threadline which was pulled away at 185 meters per minute and then packaged.

The wound yarn was highly textured and had large slubs randomly distributed along the threadline. The finished yarn had a denier of 7750.

EXAMPLE 3

Another novelty yarn sample ws made by the method set out in Example 2, with the following conditions:

Feed Yarns: Core—3 ends 1550 denier, 200 filaments light beige; Effect—2 ends 300 denier, 72 filaments (1 end black and 1 end gold/beige)
Effect Yarn Tension—2.5 to 5.0 grams
Take-off Roll Speed—155 meters per minute
Steam on vortex generator—35 p.s.i.g.

The wound yarn was highly texturized and had large slubs randomly distributed along the threadline.

EXAMPLE 4

Another novelty slub yarn was prepared by the method set out in Example 1 with the following conditions:

Feed Yarns: Core—2 ends 1550 denier, 200 filaments (1 end light beige and 1 end black); Effect—1 end 300 denier, 72 filaments red The wound yarn was highly texturized and had large slubs randomly distributed along the threadline.

EXAMPLE 5

A fine denier novelty yarn was produced according to the method set out in Example 2, with the following conditions:

Feed Yarns: Core—3 ends 420 denier, 72 filaments natural color acid-dyeable; Effect—1 end 300 denier, 72 filaments dark brown pigmented
Core Yarn Roll Speed—200 meters per minute
Take-off Roll Speed—148 meters per minute
Yarn Tension: Core Yarn—100 grams; Effect Yarn—8 to 10 grams; Winder—85 to 90 grams
Textured Yarn Denier—1950
Air Pressure to Vortex Generator—12 p.s.i.g.
Steam Pressure to Texturing Jet—105 p.s.i.g.
Texturing Jet: 0.104 inch orifice diameter tip and 0.113 inch orifice diameter seat, 26 pounds per hour steam flow.

The wound yarn was highly texturized and had large slubs randomly distributed along the threadline.

What we claim and desire to protect by Letters Patent is:

1. A method of producing a slub fiber of at least one core yarn and at least one effect yarn comprising the steps of feeding a metered core yarn through a fluid operated vortex generator, feeding an effect yarn directly into the balloon formed by the core yarn at the exit of the vortex generator while maintaining on said effect yarn a low, but continuous and relatively constant tension, to allow said effect yarn freedom to make contact at a random point on the balloon of twisting core yarn along the length of the balloon, to spontaneously form a randomized slub effect.

2. The method of claim 1 further comprising the step of passing the combined yarns through a texturizing jet to more permanently bind the core and effect yarns together.

3. The method of claim 1 in which the tension on the effect yarn is less than 30 grams.

4. The method of claim 1 in which the tension on the effect yarn is between 2 and 10 grams.

5. The slub fiber produced by the method of claim 1.

* * * * *